United States Patent [19]

Riedy

[11] Patent Number: 4,538,416

[45] Date of Patent: Sep. 3, 1985

[54] METHOD AND APPARATUS FOR VALVE MOTOR ACTUATION OF A DISPLACER-EXPANDER REFRIGERATOR

[75] Inventor: Richard C. Riedy, Allentown, Pa.

[73] Assignee: Air Products and Chemicals, Inc., Allentown, Pa.

[21] Appl. No.: 537,472

[22] Filed: Sep. 29, 1983

[51] Int. Cl.[3] ..... F25B 9/00

[52] U.S. Cl. ..... 62/6; 60/520; 137/133; 137/294

[58] Field of Search ..... 62/6; 60/520; 251/133, 251/294

[56] References Cited

U.S. PATENT DOCUMENTS 3,596,875 8/1971 Couper ..... 251/294

3,620,029 11/1971 Longsworth ..... 62/6

OTHER PUBLICATIONS

R. C. Longsworth, Interfacing Small Closed-Cycle Refrigerators to Liquid Helium Cryostats, 3/23/83, pp. 1–11.

*Primary Examiner*—Ronald C. Capossela

*Attorney, Agent, or Firm*—James C. Simmons; E. Eugene Innis

[57] ABSTRACT

A method and apparatus for producing refrigeration without loss of refrigeration or introduction of magnetic disturbance when using a displacer-expander type cryogenic refrigerator pneumatically actuated by a rotary valve coupled directly to a motor, the displacer-expander, rotary valve and motor being a single unit, by removing the motor from the unit and driving the valve by means of a flexible shaft. The flexible shaft can be disposed within a fluid conduit used to deliver high-pressure fluid to said refrigerator.

3 Claims, 1 Drawing Figure

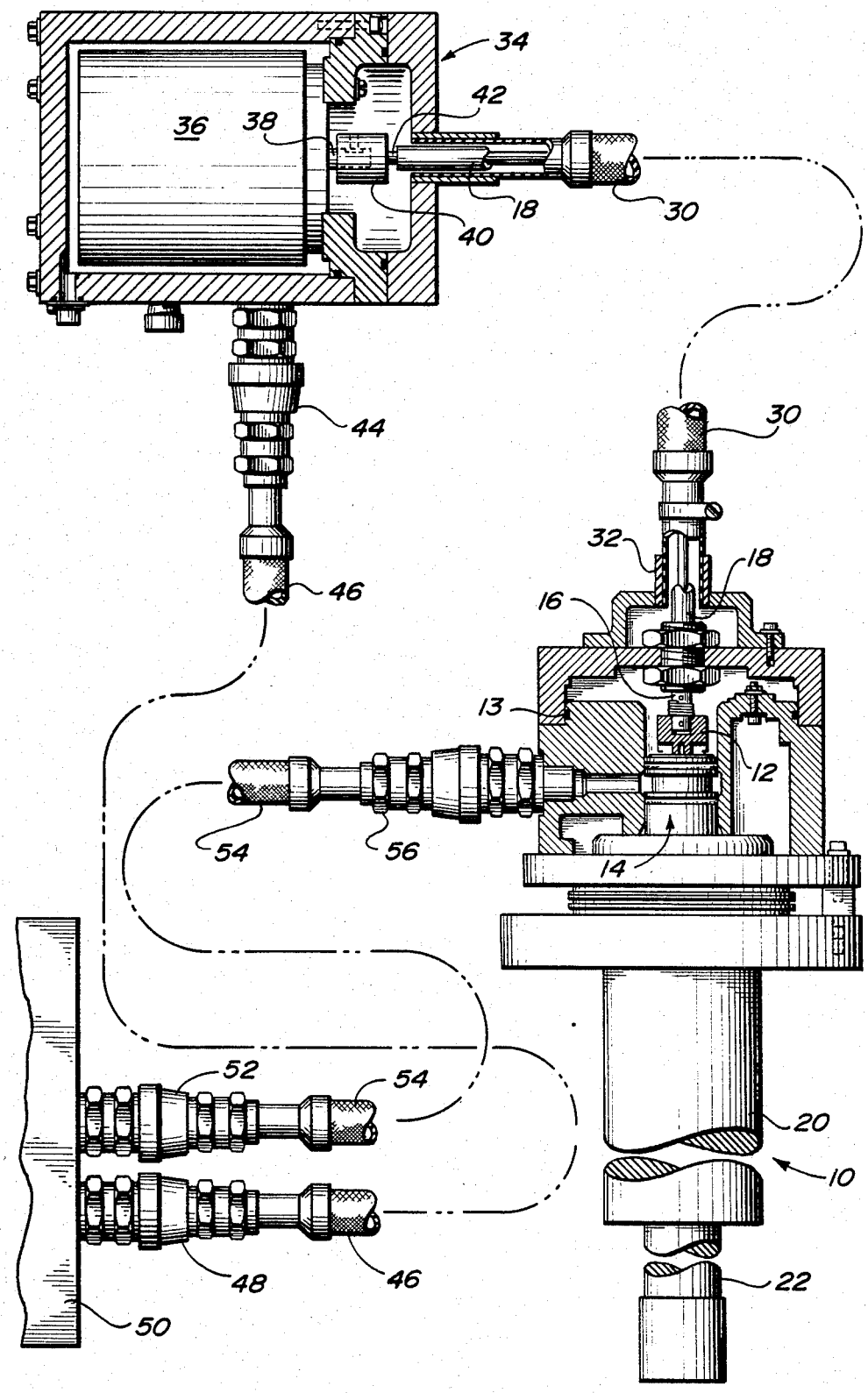
34
42
36
38
18
30
40
44
30
32
18
46
16
13
12
54
56
14
52
54
20
10
48
46
22
50

METHOD AND APPARATUS FOR VALVE MOTOR ACTUATION OF A DISPLACER-EXPANDER REFRIGERATOR

TECHNICAL FIELD

The present invention pertains to a method and apparatus for producing cryogenic refrigeration and, in particular, producing such refrigeration by means of a pneumatically actuated cryogenic expander utilizing an electrically motor-driven valve.

BACKGROUND OF THE PRIOR ART

A device for producing cryogenic refrigeration of the type for which the present invention is ideally suited is disclosed and claimed in U.S. Pat. No. 3,620,029. Patentee discloses a displacer-expander type refrigerator where the displacer is cycled against a volume of surge fluid driven through an orifice so that external driving means for the displacer are unnecessary. Work is expended by forcing the surge gas through the orifice into a surge volume chamber whereby the heat generated by such action can be removed by suitable heat exchange. The device of the U.S. Pat. No. 3,620,029 includes a ported rotary valve for admitting high-pressure fluid to the variable volume chamber or cold end of the refrigerator and exhausting low pressure expanded gas from the refrigerator. The device according the U.S. Pat. No. 3,620,029 may have more than one stage, and most current devices of this type employ two-stage refrigeration such that, at the first stage of the refrigerator, temperatures of between 35° and 85° Kelvin (K.) are achieved when helium is the working fluid and temperatures of 10° to 20° K. are achieved at the second stage with the same working fluid.

Refrigerators of the type disclosed in the U.S. Pat. No. 3,620,029 are ideally suited for use in superconducting magnets and other superconducting devices. In addition, whole body nuclear magnetic resonance (NMR) scanners, magnetic separators and Josephson junction devices require cryostats employing liquid helium cooling. A refrigerator according to the U.S. Pat. No. 3,620,029 can be used to cool radiation shields and reliquefy helium boiloff in such cryostats and to minimize helium boiloff in such devices.

In using such devices with NMR equipment, it has been found that the conventional device with the motor valve disc and expander as a single unit tended to cause magnetic disturbances in the NMR device. Separating the valve mechanism and motor from the displacer by use of long gas lines interconnecting the two led to substantial refrigeration losses because of the increased void volume in the refrigeration system.

BRIEF SUMMARY OF THE INVENTION

The present invention provides a method and apparatus for producing cryogenic refrigeration ideally suited for NMR devices wherein the introduction of magnetic disturbances is minimized, if not eliminated, and there is no loss of refrigeration from the pneumatically actuated displacer-expander type refrigerator by separation of the valve motor from the valve disc. The valve motor can be mounted a suitable distance from the displacer-expander portion of the refrigerator which contains the valve and valve disc with operation of the valve disc being effected by use of a flexible shaft which is disposed within one of the gas lines used to deliver a source of high-pressure fluid (e.g., helium) to the displacer-expander refrigerator. Maintaining the close proximity of the valve and the displacer-expander prevents the increase of void volumes and the loss of refrigeration of the device.

BRIEF DESCRIPTION OF THE DRAWING

The single FIGURE of the drawing is a front elevational view, partially fragmentary and partially in section, illustrating the method and apparatus of the present invention.

DETAILED DESCRIPTION OF THE PREFERRED EMBODIMENT

Referring to the singel FIGURE of the drawing, 10 represents the displacer expander and valve portion of the cryogenic refrigerator, such as disclosed and claimed in U.S. Pat. No. 3,620,029, the specification of which is incorporated herein by reference.

Refrigerator 10 includes valve 12 positioned by valve stem assembly 14. Valve 12 includes a coupling 16 which, in turn, is connected to a flexible shaft assembly 18.

Valve 12 rotates to uncover ports which alternately admit and exhaust high pressure fluid from the bottom of the first stage 20 and the bottom of the second stage 22 of the refrigerator 10. Disposed within the stages of the refrigerator (20, 22) is a piston which reciprocates to produce refrigeration by forcing a gas through an orifice as disclosed in the U.S. Pat. No. 3,620,029.

Flexible shaft 18 is disposed within a high pressure fluid conduit 30 which is disposed between a valve housing adapter 32 on the refrigerator assembly 10 on one end, and on the other end is disposed in fluid tight relation to a motor assembly 34. Motor assembly 34 includes an electrically actuated motor 36 having an output shaft 38. Output shaft 38 by means of coupling 40 is connected to the end 42 of flexible shaft assembly 18 opposite to that which is connected to the valve 12. Motor assembly 34 includes an inlet port assembly 44 which is adapted to admit high-pressure fluid to the motor assembly 34. High-pressure fluid can be conducted through the motor assembly to the gas conduit assembly 30 and to the valve for admission to the displacer piston in the refrigerator assembly 10. Fitting 44 is, in turn, by means of a fluid conduit 46 and fitting 48 connected to a suitable gas compressor 50 as is well known in the art. Gas compressor 50 includes a fitting 52 which is connected to a fluid pressure conduit 54 which, in turn, is connected to a fitting 56 which passes through valve assembly 13 and communicates with valve assembly 14 for exhausting low pressure fluid from the refrigerator 10 back to the compressor where it is recompressed and re-utilized as high-pressure fluid.

With the device according to the present invention, refrigeration on the order of 20° K. can be produced at the bottom or cold end of second stage 22.

The device of the present invention solves the problem of delivering cryogenic refrigeration to a point of use without either loss of available refrigeration or the introduction of magnetic disturbances caused by the valve motor being within a specified distance of the device for which the refrigeration is being used. Prior art devices utilized separation of both the valve and the valve motor from the refrigerator portion with long interconnecting gas lines between the displacer expander and the valve motor and valve assembly. The interconnecting gas lines become large void volumes which cause substantial refrigeration losses. Such devices were found to lose approximately 40 percent of the refrigeration in the first stage with approximately 20 percent refrigeration loss at the second stage when there was an 8-foot distance between the valve and valve motor assembly and the displacer-expander portion of the refrigerator. The present invention solves this problem by keeping the valve mechanism coupled to the piston assembly, thus eliminating the refrigeration losses noted above while still remotely locating the valve motor by extending its drive shaft. In the simplest embodiment of the invention, the drive shaft is mounted inside the high-pressure gas line, thus eliminating the need for a rotary gas seal. This also acts to solve any alignment or orientation problems when a flexible drive shaft is used.

Once the valve motor is removed from the displacer-expander porton of the refrigerator, the problem of magnetic disturbances is eliminated.

Having thus described my invention, what is desired to be secured by letters patent of the United States is set forth in the appended claims.

What is claimed is:

1. In a cryogenic refrigerator of the type comprising as a unitary structure, a housing containing a piston, said piston and said housing defining a variable volume chamber, means to cause reciprocation of said piston by admission of a high-pressure fluid to said variable volume chamber, said high-pressure fluid causing movement of said piston to produce refrigeration by expansion of said fluid, rotary valve means to admit and exhaust fluid from said variable volume chamber, and a motor coupled to said rotary valve means for rotation of a valve in said rotary valve means, the improvement comprising:

removing said motor from said valve assembly for mounting at a location remote from said rotary valve means and coupling said motor to said valve by means of an elongated shaft disposed within a fluid conduit used to admit a high-pressure fluid to said refrigerator.

2. In a displacer-expander type cryogenic refrigerator wherein the displacer is pneumatically actuated by a rotary valve driven at fixed speed by a motor directly coupled to said valve, said valve, said displacer and said motor being contained as one unit, the improvement comprising:

removing said motor from said valve for mounting at a location remote from said rotary valve means and coupling said motor to said valve by means of an elongated shaft disposed within a fluid conduit used to admit a high-pressure fluid to said refrigerator.

3. A method for producing refrigeration without loss of refrigeration or introduction of magnetic disturbance at the point of application of said refrigeration when using a cryogenic refrigerator of the displacer-expander type actuated pneumatically by a motor driven valve comprising the step of: removing the motor from the valve and mounting the motor remote from the displacer-expander and valve combined as a unit and coupling said motor to said valve by means of an elongated shaft disposed within a fluid conduit used to admit high-pressure fluid to such refrigerator.

* * * * *